US010985445B2

(12) United States Patent
Nikitin

(10) Patent No.: US 10,985,445 B2
(45) Date of Patent: Apr. 20, 2021

(54) WIRELESSLY RECONFIGURABLE ANTENNA

(71) Applicant: INTERMEC IP CORP., Everett, WA (US)

(72) Inventor: Pavel Nikitin, Seattle, WA (US)

(73) Assignee: INTERMEC IP CORP., Everett, WA (US)

( * ) Notice: Subject to any disclaimer, the term of this patent is extended or adjusted under 35 U.S.C. 154(b) by 583 days.

(21) Appl. No.: 15/645,310

(22) Filed: Jul. 10, 2017

(65) Prior Publication Data

US 2017/0309994 A1 Oct. 26, 2017

Related U.S. Application Data

(62) Division of application No. 13/922,095, filed on Jun. 19, 2013, now Pat. No. 9,705,183.

(51) Int. Cl.

| | |
|---|---|
| ***H01Q 1/24*** | (2006.01) |
| ***H01Q 3/24*** | (2006.01) |
| ***H01Q 21/00*** | (2006.01) |

(52) U.S. Cl.

CPC ..... *H01Q 1/245* (2013.01); *H01Q 1/248* (2013.01); *H01Q 3/24* (2013.01); *H01Q 21/005* (2013.01)

(58) Field of Classification Search

CPC ..... H01Q 1/245; H01Q 1/248; H01Q 3/24; H01Q 21/005

See application file for complete search history.

(56) References Cited

U.S. PATENT DOCUMENTS

| | | | | |
|---|---|---|---|---|
| 6,407,719 | B1 | 6/2002 | Ohira et al. | |
| 6,967,462 | B1 | 11/2005 | Landis | |
| 9,489,813 | B1 * | 11/2016 | Beigel | G08B 13/2417 |
| 2003/0193446 | A1 | 10/2003 | Chen | |
| 2003/0210203 | A1 | 11/2003 | Phillips et al. | |
| 2004/0164922 | A1 | 8/2004 | Tran | |
| 2004/0214621 | A1 | 10/2004 | Ponce De Leon et al. | |
| 2006/0022889 | A1 | 2/2006 | Chiang et al. | |
| 2006/0244581 | A1 * | 11/2006 | Breed | B60C 23/0408 340/447 |
| 2007/0080798 | A1 | 4/2007 | Jung et al. | |
| 2007/0229357 | A1 | 10/2007 | Zhang et al. | |
| 2007/0298846 | A1 * | 12/2007 | Greene | H04B 5/0037 455/572 |

(Continued)

FOREIGN PATENT DOCUMENTS

| | | | |
|---|---|---|---|
| JP | 2004-363909 | A | 12/2004 |
| JP | 2005-253043 | A | 9/2005 |

(Continued)

OTHER PUBLICATIONS

Mar. 7, 2016 Examination Report issued in British Patent Application No. 1410211.5.

(Continued)

*Primary Examiner* — Dao L Phan

(74) *Attorney, Agent, or Firm* — Alston & Bird LLP

(57) ABSTRACT

A reconfigurable antenna element is controlled using a wirelessly powered and wirelessly activated switch, where the antenna element is part of an antenna or antenna array. A control signal for reconfiguring the antenna element is embedded into a wirelessly transmitted data signal for transmission by the antenna.

16 Claims, 11 Drawing Sheets

(56) References Cited

U.S. PATENT DOCUMENTS

| | | | | |
|---|---|---|---|---|
| 2008/0246684 | A1 | 10/2008 | Fujishima et al. | |
| 2009/0046019 | A1 | 2/2009 | Sato | |
| 2010/0315045 | A1 | 12/2010 | Zeine | |
| 2011/0163921 | A1 | 7/2011 | Chirila | |
| 2011/0250928 | A1 | 10/2011 | Schlub et al. | |
| 2011/0260839 | A1 | 10/2011 | Cook et al. | |
| 2011/0264945 | A1 | 10/2011 | Tsai et al. | |
| 2011/0309980 | A1 | 12/2011 | Ali et al. | |
| 2012/0007441 | A1 | 1/2012 | John | |
| 2012/0122414 | A1 | 5/2012 | Noguchi et al. | |
| 2012/0220243 | A1 | 8/2012 | Mendolia | |
| 2014/0247020 | A1* | 9/2014 | Stankovic | A61F 2/10 320/166 |

FOREIGN PATENT DOCUMENTS

| | | | |
|---|---|---|---|
| JP | 2007-067512 | A | 3/2007 |
| WO | 2013/114378 | A1 | 8/2013 |

OTHER PUBLICATIONS

Nov. 24, 2014 Examination Report issued in British Patent Application No. 1410211.5.
Oct. 7, 2016 Examination Report issued in British Patent Application No. 1410211.5.
Feb. 9, 2018 Examination Report issued in British Patent Application No. 1718994.5.
Jun. 23, 2017 Examination Report issued in British Patent Application No. 1410211.5.
Jan. 22, 2018 Examination Report issued in British Patent Application No. 1718994.5.
Dec. 5, 2017 Combined Search and Examination Report issued in British Patent Application No. 1718994.5.
Intention to Grant for British Application 1410211.5, dated Oct. 16, 2017, 2 pages.
Intention to Grant for British Application 1718994.5, dated Mar. 19, 2018, 2 pages.
Notice of Allowance from U.S. Appl. No. 13/922,095, dated Mar. 10, 2017, 12 pages.
Noticication of Grant for British Application 1718994.5, dated May 1, 2018, 2 pages.
Notification of Grant for British Application 1410211.5, dated Oct. 16, 2017, 2 pages.
Office Action from U.S. Appl. No. 13/922,095, dated Mar. 29, 2016, 12 pages.
Office Action from U.S. Appl. No. 13/922,095, dated Sep. 29, 2016, 12 pages.
Restriction Requirement from U.S. Appl. No. 13/922,095, dated Nov. 6, 2015, 7 pages.

* cited by examiner

WIRELESSLY RECONFIGURABLE ANTENNA

CROSS REFERENCE TO RELATED APPLICATION

This is a Division of application Ser. No. 13/922,095 filed Jun. 19, 2013. The disclosure of the prior application is hereby incorporated by reference herein in its entirety.

BACKGROUND

An antenna array is made up of two or more spatially separated antenna elements. The antenna elements can be selected to produce a particular radiation pattern. Through constructive or destructive interference of the radiation patterns of the individual antenna elements in the array, the radiation pattern generated by the antenna array as a whole can be designed to provide high gain in certain directions, where the total gain is higher than can be produced by a single antenna element. Variables that can be used to adjust the radiation distribution pattern of the array include the spacing of the array elements, and adjustment of the amplitude of the excitation of the antenna elements and/or the phase shift between the antenna elements. However, a conventional reconfigurable antenna array that permits adjustment of any of these variables is complex and expensive.

BRIEF DESCRIPTION OF THE DRAWINGS

Examples of a wirelessly reconfigurable antenna are illustrated in the figures. The examples and figures are illustrative rather than limiting.

DETAILED DESCRIPTION

Described in detail below is a system for wirelessly powering and wirelessly activating a switch for controlling one or more antenna array elements. The system includes a power harvester that obtains power from a wireless signal at the local antenna element. The wireless signal includes a control signal with a command for setting the state of the switch and data to be transmitted by the antenna array element. Power obtained by the power harvester is provided to control circuitry that controls the switch coupled to the antenna array element. The switch selectively places the antenna element in either a first mode where the array element resonantly radiates the wireless signal or in a second mode where the array element is non-resonant and ineffectively radiates the wireless signal. By individually configuring the state of each individual antenna element in an antenna array, the collective radiation pattern of the antenna array is reconfigurable.

Various aspects and examples of the invention will now be described. The following description provides specific details for a thorough understanding and enabling description of these examples. One skilled in the art will understand, however, that the invention may be practiced without many of these details. Additionally, some well-known structures or functions may not be shown or described in detail, so as to avoid unnecessarily obscuring the relevant description.

The terminology used in the description presented below is intended to be interpreted in its broadest reasonable manner, even though it is being used in conjunction with a detailed description of certain specific examples of the technology. Certain terms may even be emphasized below; however, any terminology intended to be interpreted in any restricted manner will be overtly and specifically defined as such in this Detailed Description section.

A basic radio frequency (RF) switch or modulator is a device that has two states, for example, an on state and an off state. The RF switch can be used to create an RF connection between two points along a transmission path, such as between an antenna and a transmitter. Typically, an external power source is needed to operate an RF switch. However, the techniques to be presented below permit the RF field itself to power the switch and also to command the switch to turn on or off.

Slotted Metal Waveguide

Figure 1:
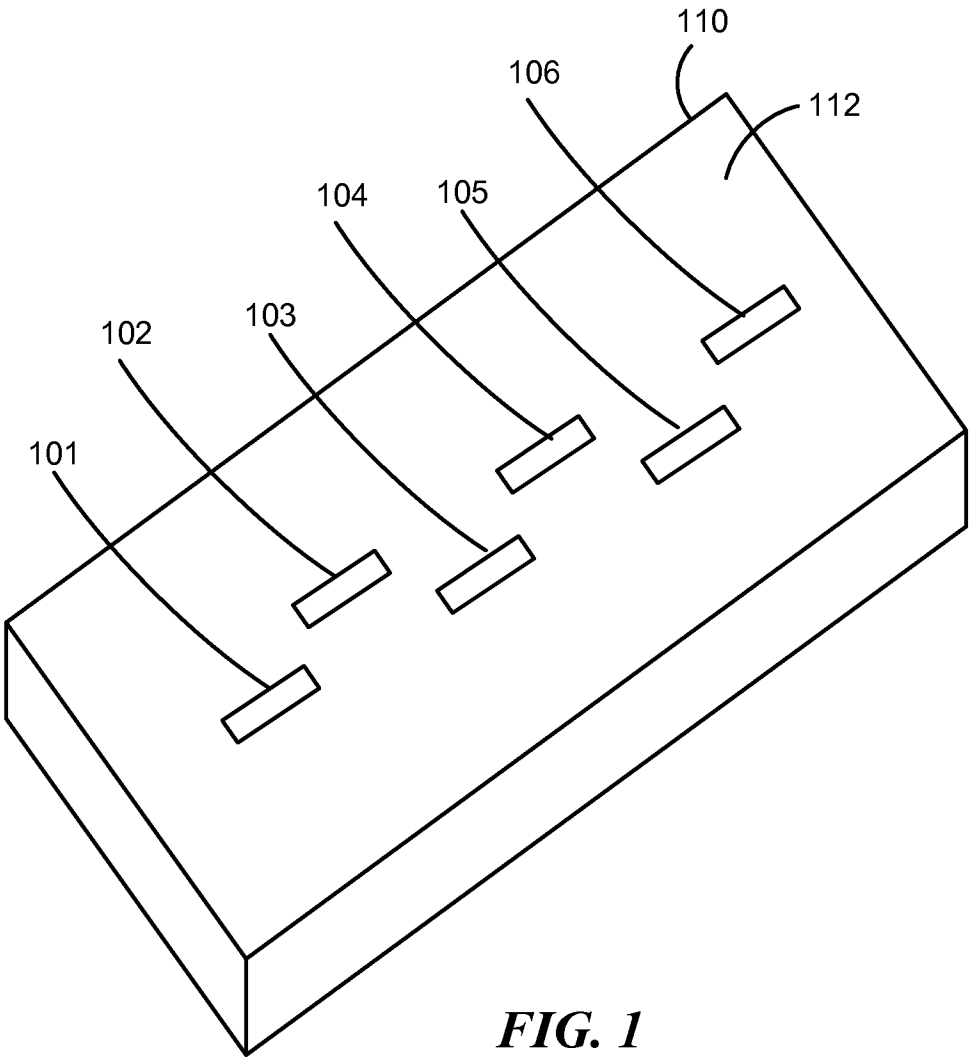
FIG. 1 shows an example of a waveguide antenna that can be adapted to be wirelessly reconfigurable.

In some implementations, a slotted metal waveguide can be used as an RF antenna. FIG. 1 shows an example of a slotted waveguide antenna 110 with a rectangular cross-section and having multiple slots 101-106 cut into the top surface 112. The waveguide antenna 110 guides an RF field that is fed into the waveguide antenna 110 through a waveguide port (not shown), and the slots 101-106 are antennas that radiate the guided RF field from the waveguide antenna 110. The specific layout of the slots 101-106 on the waveguide, such as the spacing and the size of the slots, determines the radiation distribution pattern of the slotted waveguide antenna 110.

The pattern of the slots in the waveguide can be reconfigured by using switches that affect the radiative behavior of the slots. A switch is used to either short the metal slot or leave the metal slot in an open position. If a slot in the metal waveguide 110 is shorted, then the slot no longer radiates, or radiates the RF field in an ineffective manner. However, if the slot is left in an open position, the slot will resonantly radiate the RF field from the waveguide.

Figure 2A:
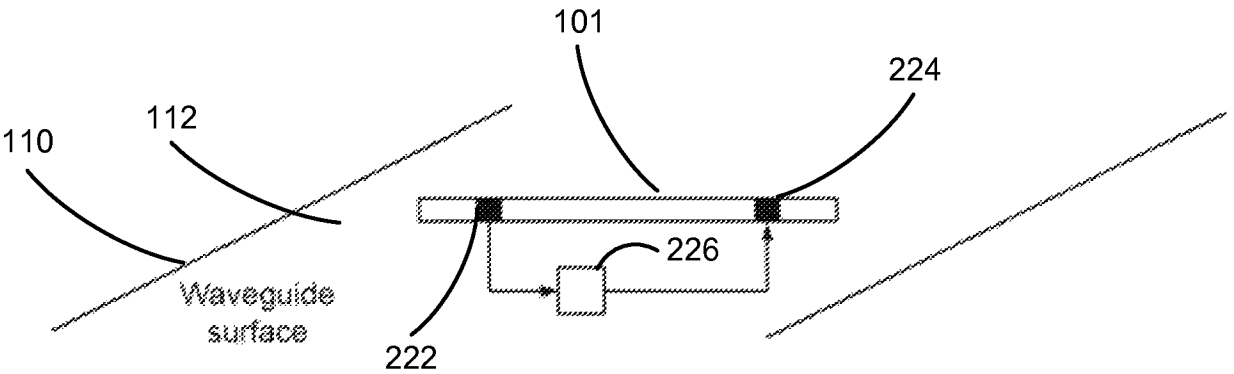
FIGS. 2A and 2B show example configurations of components that can be used to wirelessly control when a waveguide antenna radiates.

FIG. 2A shows a portion of a waveguide surface 112 of the RF waveguide 110 and slot 101 cut in the waveguide surface 112. In the example configuration shown in FIG. 2A, the slot is cut diagonally in the waveguide surface 112. However, the slot can be cut at any angle, depending on the type of waveguide and the desired radiation characteristics, e.g., radiation pattern and polarization of the entire array. A power harvester 222 is positioned across the slot 101, and a switch 224 is also positioned across the slot 101 at a different location from the power harvester 222. The configuration shown in FIG. 2A also applies to each of the other slots, 102-106, shown in FIG. 1.

The power harvester 222 obtains power from an RF field guided by the waveguide 110. Because the power harvester 222 is positioned at a different location from the switch 224 relative to the slot 101, the power harvester 222 can access the guided RF field to obtain power regardless of whether the switch 224 is open or closed. The harvested power provides power to a circuit 226 that includes a memory with stored instructions for controlling the switch 224 (e.g. as with an RFID (radio frequency identification) tag). If the circuit 226 is implemented as an integrated circuit (IC), very little power is needed to run the IC 226, on the order of tens of microwatts. Thus, whenever RF power is supplied to the waveguide 110, sufficient power will be available via the power harvester 222 to activate the switch 224. The power harvester 222 may obtain sufficient power even if it is not located at a position corresponding to a maximum amplitude for the guided RF mode.

The power harvester 222 can be implemented by soldering a coaxial cable across the slot 101 and coupling the cable to one or a series of diodes. An RF field guided by the waveguide then generates a voltage across the diodes that can power the IC 226.

The switch 224 can be a PIN diode soldered across the slot 101. When voltage is applied to the diode, the state of the switch 224 is changed, for example, from on to off or vice versa. A first state of the switch, for example, the off state, may correspond to shading the slot so that the slot ineffectively radiates, and a second state of the switch, for example, the on state, may correspond to an open slot where the slot resonantly radiates the guided RF field. By shorting a particular slot in the array of slots, the radiation distribution pattern of the waveguide antenna as a whole can be significantly changed from when the slot radiates within the array.

Alternatively, the power harvester and switch can be implemented using a circuit similar to the front-end of an RFID tag.

Figure 3:
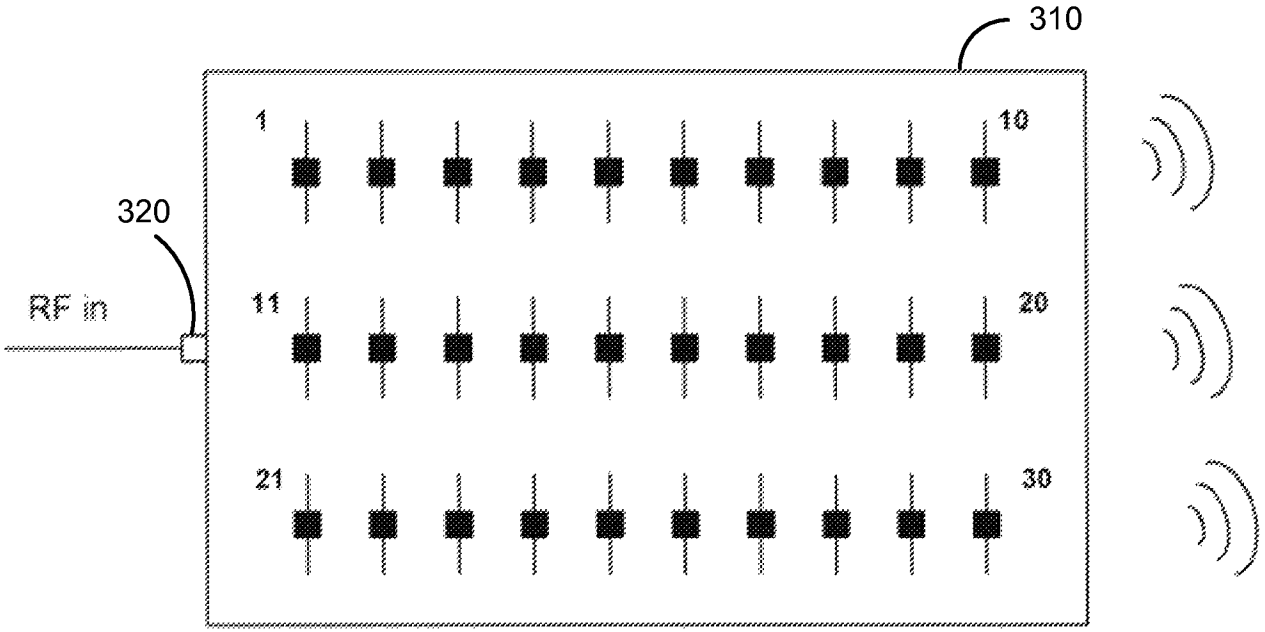
FIG. 3 shows an example wirelessly reconfigurable antenna array that has a single input port and 30 antenna elements.

FIG. 3 shows an example antenna 310 having a single RF input port 320 through which an RF signal is delivered, and having 30 antenna elements. The antenna 310 does not need to be a metal waveguide antenna that uses slots as the antenna elements. As discussed below, the antenna elements can be any type of antenna, such as patch antennas, dipole antennas and loop antennas.

Each antenna element is assigned a unique identifier so that each antenna element can be individually addressed by a control signal. While 30 antenna elements are shown, greater or fewer antenna elements can be used. Further, while three rows of ten antenna elements are shown, the antenna elements can be placed in any suitable configuration for generating desired radiation patterns from the various antenna elements.

Figure 4:
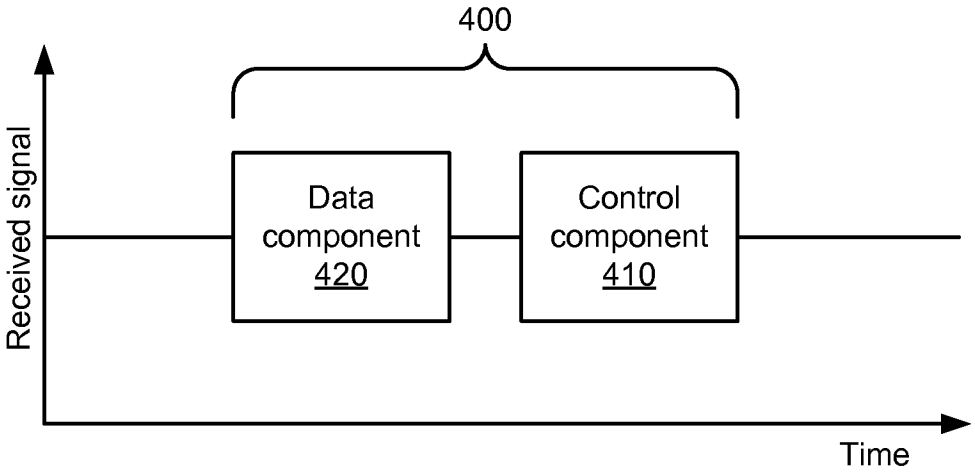
FIG. 4 shows a wirelessly transmitted signal that includes a control signal for reconfiguring antenna array elements and data to be radiated by the antenna array.
Figure 5:
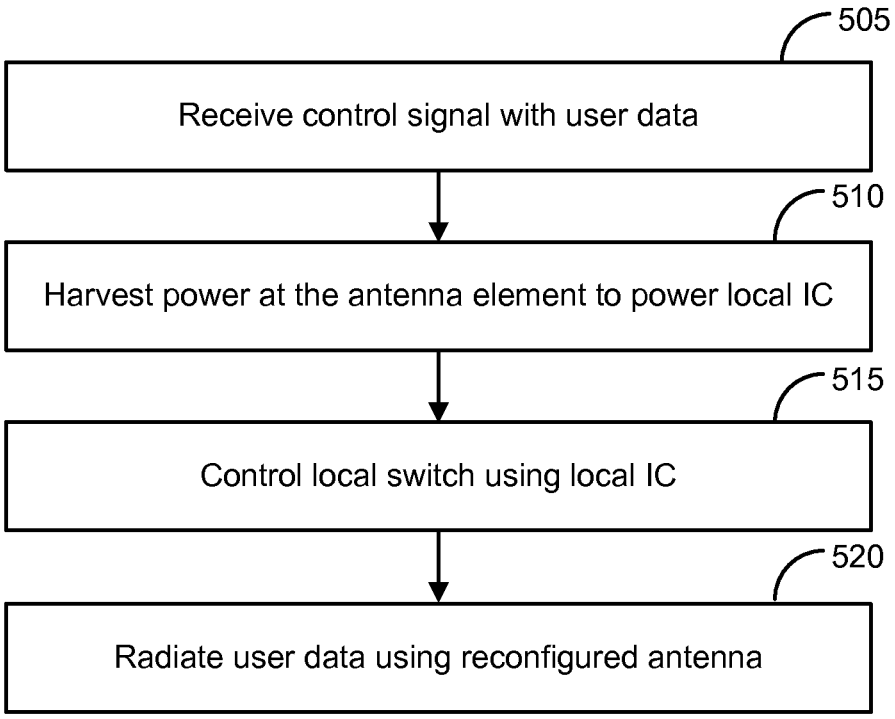
FIG. 5 is a flow diagram illustrating an example process of reconfiguring an antenna array.

FIG. 5 is a flow chart illustrating an example process for reconfiguring an antenna array, where each antenna element in the array has a power harvester located at a different position from the switch that controls the antenna element. At block 505, a control signal is received with commands to reconfigure the antenna array elements. The control signal can be embedded in the same signal used to transmit the user data. FIG. 4 shows an example of a received signal 400 that includes a control component 410 and user data component 420. The control component 410 includes the identifier of each antenna element and the state that the corresponding switch should be placed in. For example, the control component 410 can command the first IC to adjust the switch it controls to short the first slot antenna, the second IC to adjust the switch it controls to leave the second slot antenna open, the third IC to adjust the switch it controls to short the third slot antenna, etc. The user data component 420 is the data to be transmitted or radiated by the antenna. Note that the same transmission signal first reconfigures the antenna with the control component 410 and subsequently provides the user data component 420.

Then at block 510, each antenna element harvests power from the RF field to power the local IC. Next, at block 515, each IC controls the local switch for the local antenna element based upon the received control signal. Once the individual antenna elements have been reconfigured by the local ICs, at block 520, the antenna array radiates the user data in the radiation distribution pattern of the reconfigured antenna.

Co-Located Power Harvester and Switch

Figure 2B:
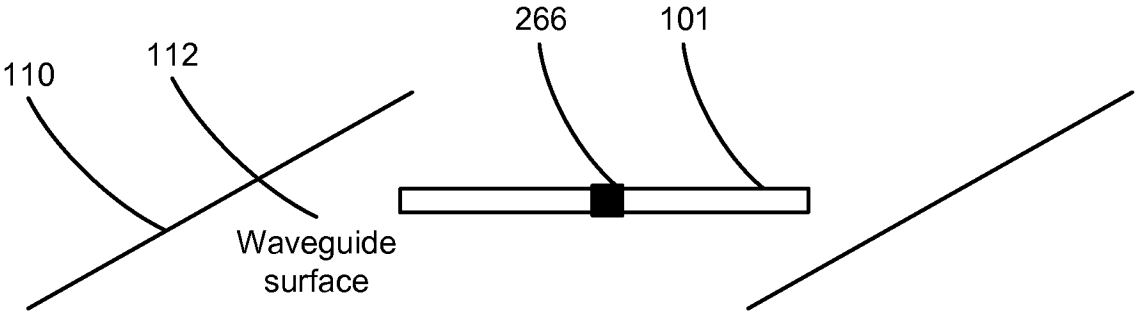

In some implementations, the power harvester 222 and the switch 224 can also be implemented in the IC 226 so that these elements are co-located. FIG. 2B shows a portion of the waveguide surface 112 of RF waveguide 110 with a slot 101 cut diagonally in the waveguide surface 112. The configuration shown in FIG. 2B also applies to each of the other slots, 102-106, shown in FIG. 1. The IC 266 is positioned so that two pins of the IC 266 straddle the slot 101. In this case, only if the switch is in a state resulting in an open slot, will the power harvester be able to obtain power from the RF field to power the IC and the switch. If the switch is in a state resulting in a shorted slot, then the power harvester will no longer be able to access the RF field. Consequently, the IC will not receive any power and will not be able to reconfigure the switch to produce an open slot, the condition under which the power harvester can again obtain power from the guided RF field.

One solution is to store in the IC memory a default state for the switch corresponding to an open slot and to use a capacitor to store energy to power the IC when no power is being generated by the power harvester from the shorted slot. The size of the capacitor can be selected to provide energy for a specific amount of time, for example, one minute or five minutes. The larger the capacitor, the more energy is stored in the capacitor, and thus, the longer the IC can operate before the power harvester needs to obtain more energy. During the time period when the IC is powered by the capacitor, the slot can remain in a shorted state. Prior to the end of this period, the IC commands the local switch to revert to the default state corresponding to an open slot.

Figure 6:
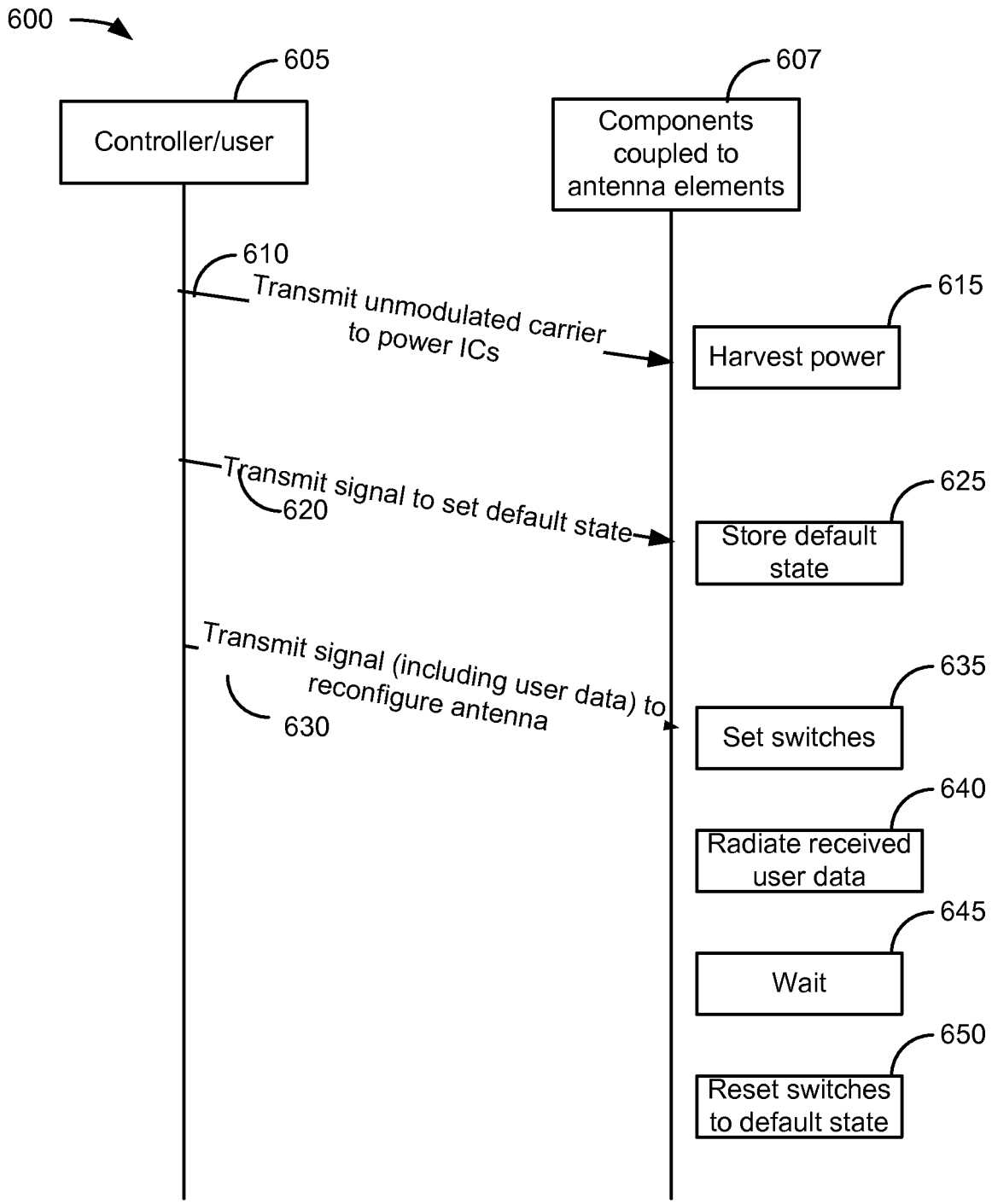
FIG. 6 is a flow diagram illustrating an example of a series of communications between a controller and elements in an antenna array.

FIG. 6 is a flow chart illustrating an example communication process 600 between an external user/controller 605 and components coupled to the antenna array elements 607 for reconfiguring an antenna array with power harvesters that are co-located with switches controlling the elements of the antenna array.

The controller 605 sends commands to the components coupled to the antenna array elements 607. The actions of the controller 605 on the left and the components 607 on the right are shown relative to each other as a function of time, with time increasing in the downward direction in FIG. 6. Transmissions from the controller 605 to the components 607 coupled to the antenna array elements are shown by the arrows crossing the center of FIG. 6.

At transmission 610, the controller 605 transmits an unmodulated carrier so that the power harvesters in the antenna array can initially obtain power for running the ICs. At block 615, the power harvesters harvest power from the RF field of the unmodulated carrier.

Next, at transmission 620, the controller 605 transmits a signal to the ICs to set a default state in memory for each of the switches, and the default state for the switches correspond to an open slot. At block 625, the default state is set by the ICs.

Then the controller 605 transmits a control signal to reconfigure the antenna array elements along with user data. The control signal includes different identifiers for each of the antenna array elements and specifies a state to which the corresponding switch is to be set. At block 635, the ICs in the array set the state of the respective switches as commanded by the control signal. Then at block 640, the reconfigured antenna array radiates the transmission which includes the user data. The components coupled to the antenna elements wait a predetermined period of time corresponding to the amount of time the capacitors can power the ICs. Prior to the end of the predetermined period of time, the ICs reset the respective switches to the stored default state. The process repeats with the transmission 610.

Dipole Antenna Array

Figure 7A:
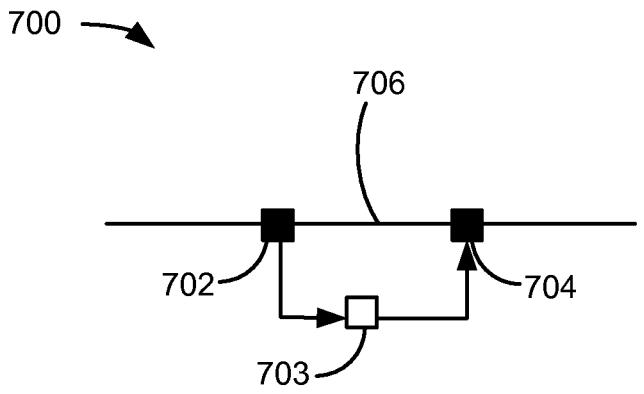
FIGS. 7A and 7B show example configurations of components that can be used with a dipole antenna as an antenna array element to wirelessly control when the dipole antenna radiates.

As another example, dipole antennas can be used as an antenna array element, instead of slot antennas FIG. 7A shows an example configuration 700 of components used with dipole antennas as the antenna array element, where the power harvester and the switch are not co-located. Similar to the configuration with the slot antenna described above, a dipole antenna 706 can have a power harvester 702 positioned at a first location with respect to the dipole antenna 706 and a switch 704 positioned at a second location with respect to the dipole antenna 706. The power obtained by the power harvester 702 powers an IC 703 which activates the switch 704. The power harvester 702 can be implemented in a similar manner as the power harvester 222 used with the slot antenna.

The dipole antenna 706 is made up of two separate pieces. When the two pieces are connected, they radiate as the dipole antenna 706. The switch 704 connects the two pieces of the dipole antenna 706. When the switch 704 is closed, the two pieces are connected to form the dipole antenna 706. When the switch 704 is open, the pieces are disconnected and do not radiate effectively as a dipole antenna. The switch 704 is implemented in a similar manner as the switch 224 used with the slot antenna. The method of operating the dipole antenna with the power harvester and switch at different positions is described by the flow chart of FIG. 5.

Figure 7B:
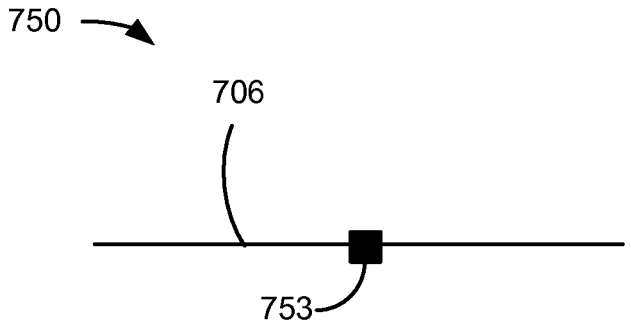

Also similar to the slot antenna, a co-located power harvester and switch, implemented in an IC, can be used with the dipole antenna. FIG. 7B shows an example configuration 750 of components used with a dipole antenna where the power harvester and the switch are co-located and implemented in IC 753. IC 753 is positioned so that two pins of the IC 753 couple the two pieces of the dipole antenna 706. If the switch is open so that the full dipole antenna is not formed, the power harvester cannot effectively obtain power. Only when the switch is closed and the dipole antenna is formed, can the power harvester obtain sufficient power to power the IC 753. The method of operating the dipole antenna 706 with a co-located power harvester and switch is described by the flow chart of FIG. 6.

While the specific antenna array element examples of a slot antenna and a dipole antenna have been discussed above, any type of antenna can be used as an antenna array element, such as patch and loop antennas. The techniques discussed herein are also applicable to other types of antenna array elements, and even to different types of antenna elements used in a single antenna array.

Figure 10A:
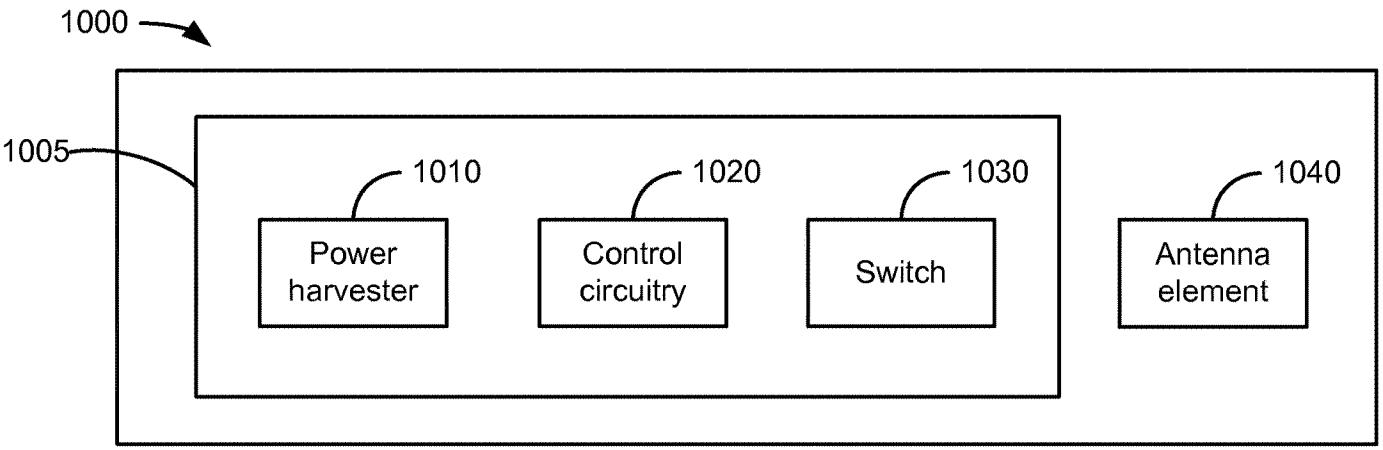
FIGS. 10A and 10B show block diagrams of example components used for reconfiguring an antenna array element.
Figure 10B:
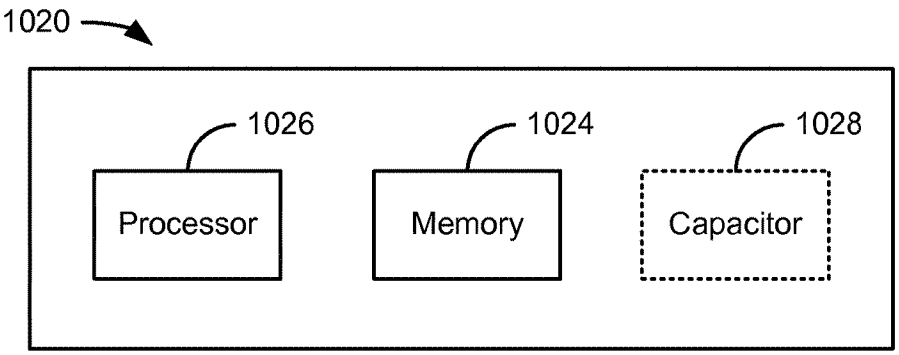

FIGS. 10A and 10B show block diagrams of example components used for reconfiguring an antenna array element 1040. The components 1005 can include a power harvester 1010, control circuitry 1020, and at least one switch 1030. The power harvester 1010 obtains power from a wireless signal received at the antenna element 1040 to power the control circuitry 1020. The power harvester can be a simple coaxial cable coupled to one or more diodes The control circuitry 1020 can be a processor or logic circuitry that controls the switch 1030 to selectively place the antenna element 1040 in an appropriate radiating or non-radiating mode.

As shown in FIG. 10B, the control circuitry 1020 can include a memory 1024, a processor 1026, and, optionally, a capacitor 1028. The processor 1026 processes the control signal transmitted in the wireless signal and received by the antenna element 1040. The processor 1026 then controls the switch 1030 responsive to the control signal. Instructions for the processor may be stored in the memory 1024. The memory can also store a default state for the switch 1030. The memory 1024 may be any combination of volatile and non-volatile memory.

The control circuitry 1020 can also include a capacitor 1028 for storing energy harvested by the power harvester 1010.

Handheld Device Application

The above-described techniques can be used to reconfigure the antenna radiation pattern for a handheld device, such as a mobile phone or a handheld radio frequency identification (REID) tag reader, a moving vehicle, etc. Examples of antenna radiation patterns emitted by these devices include an omni-directional radiation pattern and radiation in a forward direction, where the antennas are designed to radiate into a large solid angle. With these types of radiation patterns, the radiation is automatically directed toward a user's head and/or body when the device is brought near the user's head during operation of the device. Thus, it would be advantageous to redirect the radiation away from the user in this situation.

Figure 8B:
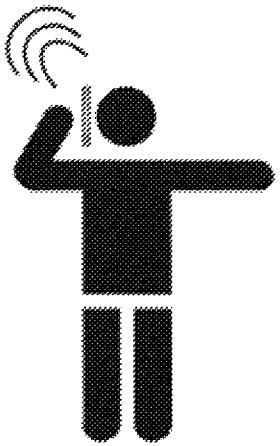
FIGS. 8A and 8B show examples of different antenna radiation patterns for a handheld device.
Figure 8A:
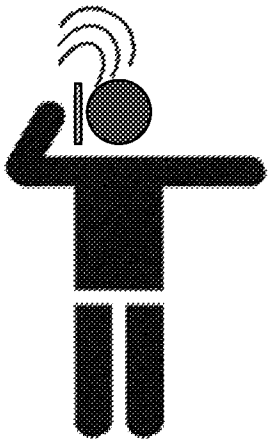

FIGS. 8A and 8B show examples of different antenna radiation patterns for a handheld device. FIG. 8A shows an example scenario where the device is held near the user's head, and the radiation pattern of the antenna has not been reconfigured and is directed toward the user's head. Depending upon the particular antenna radiation pattern, the radiation can also be directed toward the user's body. FIG. 8B shows an example scenario where the antenna of the handheld device has been reconfigured to radiate in a direction away from the user.

A typical handheld device is designed to perform many functions while still maintaining as compact a form as possible. One of those functions includes transmitting information wirelessly via an antenna. Because there is very little unused space inside the compact housing of the device, a typical device cannot accommodate a large reconfigurable antenna array for adjusting the radiation pattern. In this case, one or more simple parasitic antenna elements and/or one or more active antenna elements can be positioned in or on the housing of the device near the fixed antenna to change the radiation pattern of the fixed antenna when the device is moved next to the user's head and/or near the user's body.

A parasitic element can be made up of two disconnected short metal strips that are individually non-resonant with the fixed antenna, and thus, unlikely to affect the radiation pattern of the fixed antenna when disconnected. A switch is positioned between the two metal strips. When the switch is in a first state, it causes the two metal strips to remain disconnected so that the two non-resonant metal strips do not affect the radiation pattern of the antenna. When the switch is in a second state, the switch shorts the two metal strips together so that the two strips function as a single resonant passive element that changes the radiation pattern of the fixed antenna. One or more parasitic elements can be used with the fixed antenna.

An active or driven antenna element can be a switched branch coupled to the high impedance part of the fixed antenna, where the high impedance part is insensitive to whether anything is coupled to it. When the switch connects the active antenna element to the fixed antenna, the resulting radiation pattern from the combined antennas is different from the fixed antenna radiating alone. One or more active antenna elements can be used with the fixed antenna.

Figure 9:
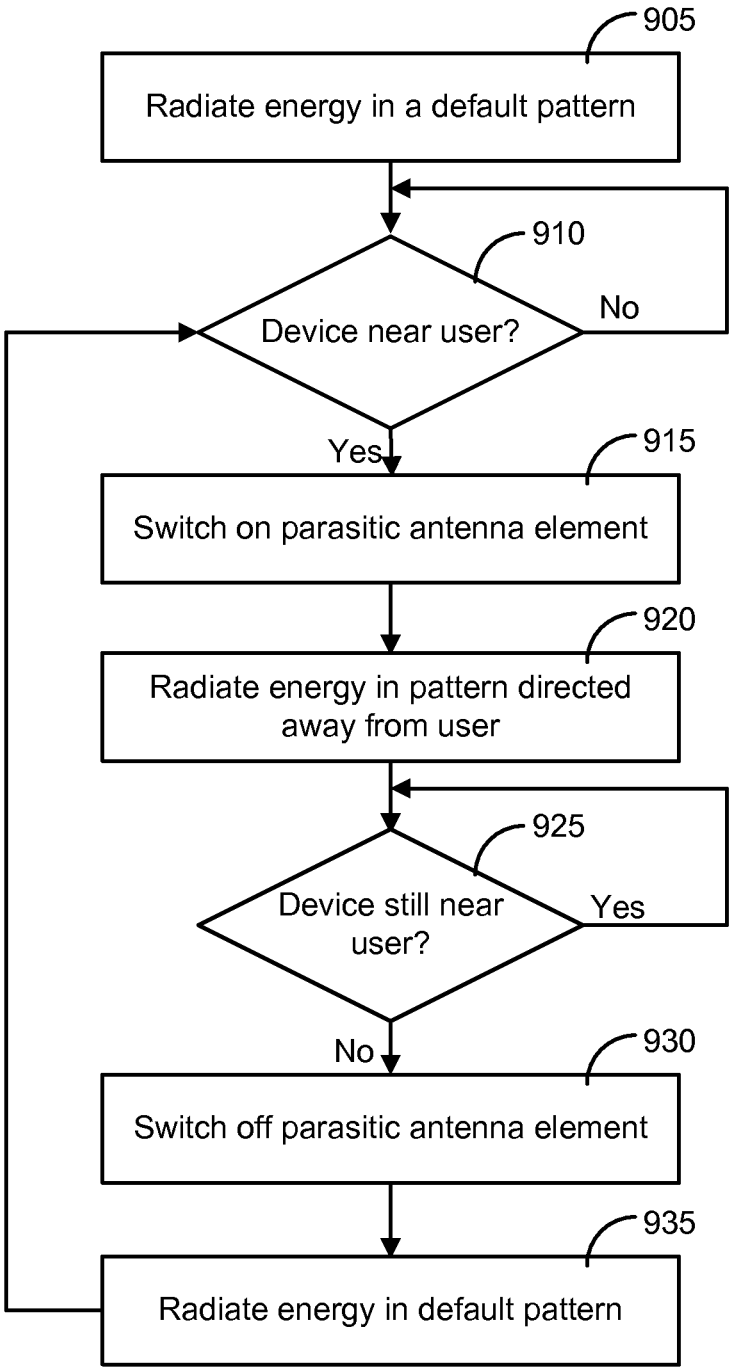
FIG. 9 is a flow diagram illustrating an example process of adjusting the radiation pattern of a handheld device when used near a user.

FIG. 9 is a flow chart illustrating an example process for reconfiguring a radiation distribution pattern of an antenna in a handheld device to steer the antenna's radiation pattern away from a user. The handheld device can include more than one antenna that radiate RF energy at different frequencies. Each one of the antennas can have its own wirelessly reconfigurable parasitic element for redirecting the radiation distribution pattern of the respective antenna.

At block 905, when the handheld device is operated in front of the user, the handheld device antenna radiates energy in a default pattern, such as an omni-directional radiation pattern or radiation in a forward direction, using one of the fixed antennas. In this mode, the corresponding components of the parasitic element remain disconnected and non-resonant with the fixed antenna.

Next, at decision block 910, the handheld device determines if the device is near the users head or any part of the user's body. A user may bring the device closer to the user's head if the user wants to see the screen better or to listen to an audio signal from the device. To detect when the device is near the user's head, the handheld can include a proximity sensor on the display surface of the device. Other types of sensors can also be used in addition to or instead of the proximity sensor. The device can be considered to be proximate to the user if the distance between the device and the user is less than a pre-defined threshold, for example, six inches. If the device does not sense proximity to the user's head or body (block 910—No), the process remains at decision block 910.

If the device senses proximity to the user's head or body (block 910—Yes), at block 915, the device controls a switch to reconfigure the separate metal strips as a single parasitic antenna element for the fixed antenna that is being used by the device to transmit information. Essentially, the parasitic element is switched on. Then at block 920, the fixed antenna in conjunction with the parasitic element radiates the energy in a new pattern designed to be directed away from the user's head and body.

Next, at decision block 925, the device uses its proximity sensor to determine whether it is still near the user's head or body. If the device is still near the user's head or body (block 925—Yes), the process remains at decision block 925. If the device has been moved away from the user (block 925—No), at block 930 the device changes the switch setting so that the two short metal strips of the parasitic antenna are no longer coupled and are no longer resonant with the fixed antenna, thus rendering the components of the parasitic element ineffective in modifying the radiation pattern from the default pattern. In this state, the parasitic element can be considered to be switched off. At block 935, the fixed antenna again radiates in the default radiation pattern, and the process returns to decision block 910.

Figure 11:
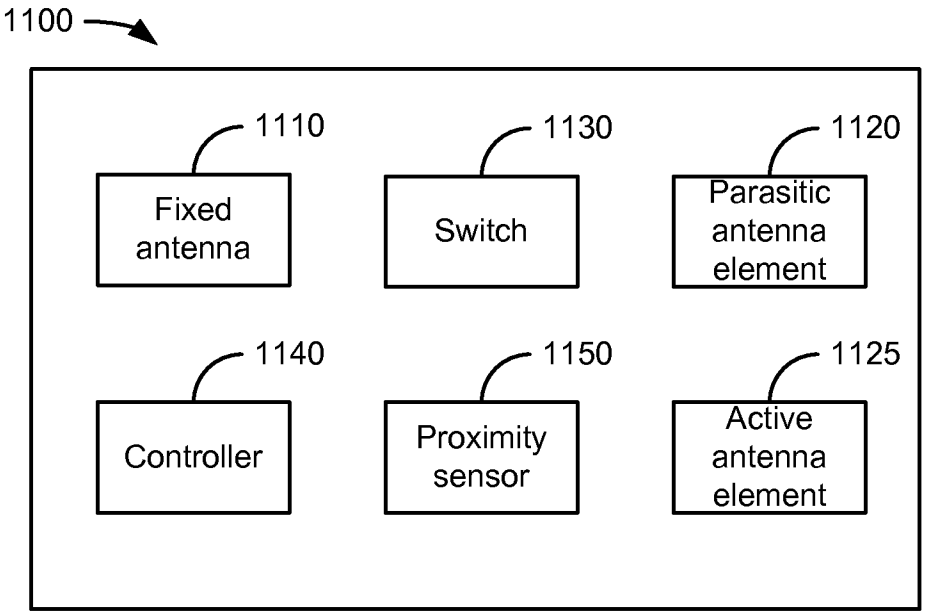
FIG. 11 shows a block diagram of example components in a handheld device that can adjust its radiation pattern based on proximity to a user.

FIG. 11 shows a block diagram of example components in a handheld device that can adjust its radiation pattern based on proximity to a user. The components 1100 can include a fixed antenna 1110, one or more parasitic antenna elements 1120 and/or active antenna elements 1125, a switch 1130, a controller 1140, and a proximity sensor 1150.

The fixed antenna 1110 can be any type of antenna that transmits signals wirelessly with a specific radiation pattern, for example, a slot antenna, dipole antenna, patch antenna, pifa (planar inverted-F antenna), and helix antenna.

The parasitic antenna element 1120 has two sub-elements that when connected, make the parasitic antenna element resonant with the fixed antenna 1110. And when the two sub-elements are disconnected, neither sub-element is resonant with the fixed antenna 1110. The two sub-elements can be straight metal strips placed end to end near each other. The switch 1130 connects and disconnects the two sub-elements of the parasitic antenna element 1120.

The active antenna element 1125 is a driven antenna element that can be switched to connect to the fixed antenna 1110.

The proximity sensor 1150 can be any type of sensor that can determine how far away the user's body and/or head is from the handheld device. The controller 1140 is a processor or logic circuitry that sets the state of the switch to connect or disconnect the two sub-elements of the parasitic antenna element 1120 depending upon the determination of the proximity sensor 1150.

The above-described techniques can also be used in another application where the power harvester and switch elements are used to wirelessly turn on and off electronic devices without using additional power lines or control lines. For example, in this scenario, the switch is used to turn the device on and off, while the power harvester obtains power from an antenna element, and the antenna element receives remote commands for controlling the power to the device. Alternatively or additionally, multiple switches can be controlled to manipulate different functions of the device.

CONCLUSION

Unless the context clearly requires otherwise, throughout the description and the claims, the words "comprise," "comprising," and the like are to be construed in an inclusive sense (i.e., to say, in the sense of "including, but not limited to"), as opposed to an exclusive or exhaustive sense. As used herein, the terms "connected," "coupled," or any variant thereof means any connection or coupling, either direct or indirect, between two or more elements. Such a coupling or connection between the elements can be physical, logical, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above Detailed Description of examples of the invention is not intended to be exhaustive or to limit the invention to the precise form disclosed above. While specific examples for the invention are described above for illustrative purposes, various equivalent modifications are possible within the scope of the invention, as those skilled in the relevant art will recognize. While processes or blocks are presented in a given order in this application, alternative implementations may perform routines having steps performed in a different order, or employ systems having blocks in a different order. Some processes or blocks may be deleted, moved, added, subdivided, combined, and/or modified to provide alternative or subcombinations. Also, while processes or blocks are at times shown as being performed in series, these processes or blocks may instead be performed or implemented in parallel, or may be performed at different times. Further any specific numbers noted herein are only examples. It is understood that alternative implementations may employ differing values or ranges.

The various illustrations and teachings provided herein can also be applied to systems other than the system described above. The elements and acts of the various examples described above can be combined to provide further implementations of the invention.

Any patents and applications and other references noted above, including any that may be listed in accompanying filing papers, are incorporated herein by reference. Aspects of the invention can be modified, if necessary, to employ the systems, functions, and concepts included in such references to provide further implementations of the invention.

These and other changes can be made to the invention in light of the above Detailed Description. While the above description describes certain examples of the invention, and describes the best mode contemplated, no matter how detailed the above appears in text, the invention can be practiced in many ways. Details of the system may vary considerably in its specific implementation, while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above Detailed Description section explicitly defines such terms. Accordingly, the actual scope of the invention encompasses not only the disclosed examples, but also all equivalent ways of practicing or implementing the invention under the claims.

While certain aspects of the invention are presented below in certain claim forms, the applicant contemplates the various aspects of the invention in any number of claim forms. For example, while only one aspect of the invention is recited as a means-plus-function claim under 35 U.S.C. § 112, sixth paragraph, other aspects may likewise be embodied as a means-plus-function claim, or in other forms, such as being embodied in a computer-readable medium. (Any claims intended to be treated under 35 U.S.C. § 112, If 6 will begin with the words "means for.") Accordingly, the applicant reserves the right to add additional claims after filing the application to pursue such additional claim forms for other aspects of the invention.

I claim:

1. An apparatus to control a radiative state of at least one antenna element, the apparatus comprising:

a power harvester coupled to the at least one antenna element, wherein the power harvester is configured to obtain power from a received wireless signal, and wherein the received wireless signal includes a control component and a data component; and a switch coupled to the power harvester, wherein the switch is powered by the obtained power, and wherein the switch is addressable via the control component comprising a unique identifier of the at least one antenna element and an indication to turn the switch on or off, wherein, responsive to the control component, the switch turns on and off, wherein upon the switch being turned on, the at least one antenna element resonantly radiates a wireless signal, and wherein upon the switch being turned off, the at least one antenna element ineffectively radiates the wireless signal.

2. The apparatus of claim 1, wherein the at least one antenna element forms part of an antenna array, wherein the power harvester and the switch are positioned at different locations along the at least one antenna element.

3. The apparatus of claim 1, wherein the device further comprises:

a control circuit powered by the power harvester and configured to control the switch responsive to the control component.

4. The apparatus of claim 3, wherein the device further comprises a capacitor for storing at least a portion of the obtained power, and further wherein the power harvester, the control circuit, the switch, and the capacitor are implemented in an integrated circuit, and the integrated circuit is positioned relative to the at least one antenna element such that the power harvester does not have access to the received wireless signal to obtain power when the switch is off, and the capacitor powers the integrated circuit when the switch is off.

5. The apparatus of claim 4, wherein after a predetermined period of time elapses after the control circuit turns the switch off, the control circuit turns the switch on such that the power harvester can access the received wireless signal to obtain power.

6. The apparatus of claim 1, wherein the at least one antenna element is one of multiple antenna elements, and the at least one antenna element is a slot in a slotted waveguide.

7. The apparatus of claim 1, wherein the at least one antenna element is at least part of a dipole antenna.

8. A reconfigurable antenna array comprising:

multiple means for radiating, configured to operate in a first mode and a second mode, wherein in the first mode, the means for radiating radiates resonantly, and in the second mode, the means for radiating does not radiate effectively; and multiple switches, wherein each switch has a unique identifier and is coupled to one of the means for radiating;

wherein each switch is addressable via a wireless signal, using the unique identifier for the switch, to turn the addressed switch on or off, wherein when a given switch is on, the coupled means for radiating operates in the first mode, and when the given switch is off, the coupled means for radiating operates in the second mode, and further wherein the multiple switches are powered wirelessly by the wireless signal.

9. The reconfigurable antenna array of claim 8, wherein the wireless signal includes commands addressed to at least some of the multiple switches and data to be radiated by the reconfigurable antenna array.

10. The reconfigurable antenna array of claim 8, further comprising:

multiple logic components, wherein each logic component is coupled to one of the switches and is configured to control the coupled switch responsive to the wireless signal; and multiple power modules, wherein each power module is coupled to one of the switches and one of the logic components, and each power module is configured to obtain power from the wireless signal for powering the coupled switch and the coupled logic component.

11. The reconfigurable antenna array of claim 10, wherein each power module and each switch coupled to a given means for radiating are positioned at different locations along the given means for radiating.

12. The reconfigurable antenna array of claim 10, wherein the reconfigurable antenna array further comprises multiple capacitors, wherein each capacitor is coupled to one of the power modules and one of the logic components, and wherein each capacitor is configured for storing at least a portion of the obtained power, wherein the power modules, the logic components, the switches, and the capacitors are implemented in an integrated circuit, and the integrated circuit is positioned relative to the antenna array element such that when the switch is on, the power modules can access the wireless signal to obtain power, and further wherein the capacitors power the logic components when the switches are off.

13. The reconfigurable antenna array of claim 8, wherein the multiple means for radiating are slots in a slotted waveguide.

14. A method of configuring an antenna element, the method comprising:

receiving, at the antenna element, a first wireless signal and a command, wherein the first wireless signal comprises data and the command comprises a unique identifier of the antenna element and an indication for setting a switch to an on state or an off state;

harvesting power from the first wireless signal received at the antenna element to power the switch and a control circuitry;

setting, by the control circuitry, the switch to the on state or the off state responsive to the command; and effectively radiating the first wireless signal by the antenna element when the switch is in the on state and ineffectively radiating the first wireless signal by the antenna element when the switch is in the off state.

15. The method of claim 14, further comprising storing the harvested power for use when the switch is in the off state and power is unavailable for harvesting from the wireless signal.

16. The method of claim 15, further comprising:

returning the switch to the on state after a predetermined period of time has elapsed with the switch in the off state; and harvesting power from a second wireless signal received at the antenna element.

* * * * *